US006856783B2

(12) United States Patent
Kikuchi

(10) Patent No.: US 6,856,783 B2
(45) Date of Patent: Feb. 15, 2005

(54) FIXING APPARATUS

(75) Inventor: Kazuhiko Kikuchi, Yokohama (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 42 days.

(21) Appl. No.: 10/602,920

(22) Filed: Jun. 25, 2003

(65) Prior Publication Data

US 2004/0001732 A1 Jan. 1, 2004

(30) Foreign Application Priority Data

Jun. 27, 2002 (JP) ..... 2002-188545

(51) Int. Cl.[7] ..... G03G 15/00
(52) U.S. Cl. ..... 399/328
(58) Field of Search ..... 399/328, 320

(56) References Cited

U.S. PATENT DOCUMENTS

2002/0030050 A1 * 3/2002 Takagi et al. ..... 219/619

FOREIGN PATENT DOCUMENTS

JP 9-258586 A 10/1997
JP 10-74005 A 3/1998

* cited by examiner

*Primary Examiner*—Quana Grainger
(74) *Attorney, Agent, or Firm*—Foley & Lardner LLP

(57) ABSTRACT

The fixing apparatus includes an induction heating device provided inside the fixing roller, configured to heat the fixing roller by induction heating, and the induction heating device further includes a core member and an excitation coil wound around the core member, and where the inner diameter of the heat roller is represented by D, the width of the portion of the core member, which opposes at least the heat roller is represented by B, the inductance of the excitation coil is L[$\mu$H] and the resistance of the heat roller is R[$\Omega$], B is set to be larger than L/R×0.3 and less than D/3.

5 Claims, 5 Drawing Sheets

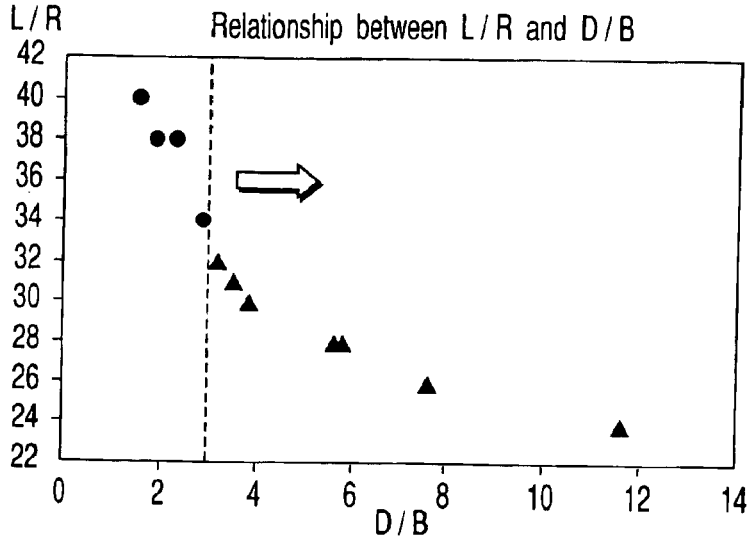
FIG. 8
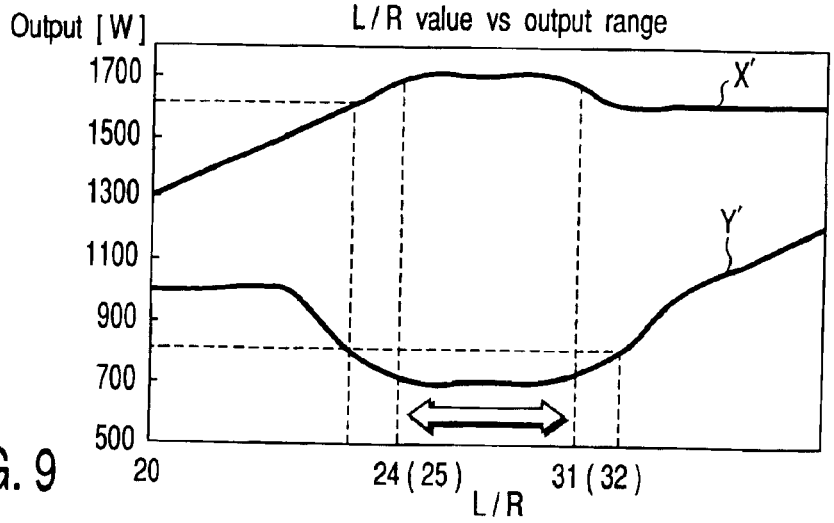
FIG. 9
■ Measurements
| | Measured value 1 | | Measured value 2 | | Measured value 3 | |
|---|---|---|---|---|---|---|
| | Center coil | End portion coil | Center coil | End portion coil | Center coil | End portion coil |
| L | 27.3 | 29.5 | 29.3 | 31.4 | 28.6 | 31.4 |
| R | 0.89 | 1.00 | 1.15 | 1.22 | 1.09 | 1.21 |
| L/R | 30.7 | 29.5 | 25.5 | 25.8 | 26.2 | 26.0 |
| B | 10.0 | 10.0 | 10.0 | 10.0 | 10.0 | 10.0 |
| D | 57.0 | 57.0 | 57.0 | 57.0 | 57.0 | 57.0 |
FIG. 10

FIXING APPARATUS

CROSS-REFERENCE TO RELATED APPLICATIONS

This application is based upon and claims the benefit of priority from the prior Japanese Patent Application No. 2002-188545, filed Jun. 27, 2002, the entire contents of which are incorporated herein by reference.

BACKGROUND OF THE INVENTION

1. Field of the Invention

The present invention relates to a fixing apparatus, which is equipped in, for example, an electronic photocopier.

2. Description of the Related Art

Some fixing apparatus of the above-mentioned type include a metallic heat roller and an elastic pressure roller that is set in pressure contact with the heat roller. The heat roller comprises a halogen lamp or the like, serving as a heat source, and it is heated by the radiant heat of the halogen lamp.

Paper sheets on which toner images have been transformed are allowed to pass between the heat roller and pressure roller, and thus each sheet is heated and pressurized, thereby fixing the toner image on the sheet.

On the other hand, according to conventional techniques, the heat roller is heated by heating the air within the heat roller by means of light radiated from the halogen lamp. With this structure, when the light is converted into heat energy, heat loss occurs. Further, the efficiency of transmitting heat to the heat roller is poor. Consequently, the heat exchange efficiency is as low as 60 to 70%, and thus the conventional techniques have a disadvantage in terms of energy conservation.

Further, because of the low heat exchange efficiency, the conventional techniques entail a drawback of requiring a great amount of time to warm up the fixing apparatus.

Under the circumstances, recently, a fixing apparatus that utilizes the induction heating method has been developed as discussed in Jap. Pat. Appln. KOKAI Publication No. 9-258586.

Jap. Pat. Appln. KOKAI Publication No. 9-258586 discloses a fixing apparatus that comprises a coil assembly obtained by winding a coil around a core member, which is provided along the rotation shaft of the fixing roller. Here, the fixing roller is heated with the coil assembly by allowing an eddy current to flow to the assembly.

In such a prior art technique, with a structure of winding a coil around a core member, the magnetic flux generated can be concentrated and thus a high output can be obtained. However, at the same, due to the structure in which a core member with a coil wound therearound is placed in the device in the prior art technique, it would require, in addition to the heavy core member itself, a bobbin for winding the coil and a holder for holding the core member. As a result, the heat roller is increased in size as well as in weight.

There has been an attempt of thinning the core member in order to reduce the size and weight of the heat roller. However, in this case, it brings another drawback of creating magnetic saturation since the temperature of the core member is easily increased during the process of heating the heat roller. Consequently, the output range of the excitation coil is lowered, thereby making not possible to heat the heat roller sufficiently.

BRIEF SUMMARY OF THE INVENTION

The present invention has been achieved in consideration of the above-described circumstances, and the object of the invention is to provide a small-size and light-weight fixing apparatus of an induction heating type, which can prevent the occurrence of magnetic saturation, which is caused by an increase in the temperature of the core member even if the core member is made thin.

According to an embodiment of the present invention, there is provided a fixing apparatus comprising: a fixing device including a fixing roller and a press roller set in contact with the fixing roller, configured to heat and press a to-be-fixed material by making the material pass between the fixing roller and press roller; and an induction heating device provided inside the fixing roller, configured to heat the fixing roller by induction heating, wherein the induction heating device includes a core member and an excitation coil wound around the core member, and the apparatus satisfies a relationship represented by $L/R \times 0.3 \leqq B \leqq D/3$ where D represents an inner diameter of the heat roller, L[$\mu$H] represents an inductance of the excitation coil, R[$\Omega$] represents a resistance of the heat roller, and B represents a width of a portion of the core member, which opposes at least the heat roller.

Additional objects and advantages of the invention will be set forth in the description which follows, and in part will be obvious from the description, or may be leaned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

FIG. 8 is a graph indicating the relationship between the D/B value and L/R value of the fixing apparatus;

FIG. 9 is a graph indicating the relationship between the L/R value and the output range of the excitation coil of the fixing apparatus; and FIG. 10 is a table indicating measurement values of L, R, L/R, B and D in the central coil and end portion coil of the fixing apparatus.

DETAILED DESCRIPTION OF THE INVENTION

An embodiment of the present invention will now be described in detail with reference to accompanying drawings.

Figure 1:
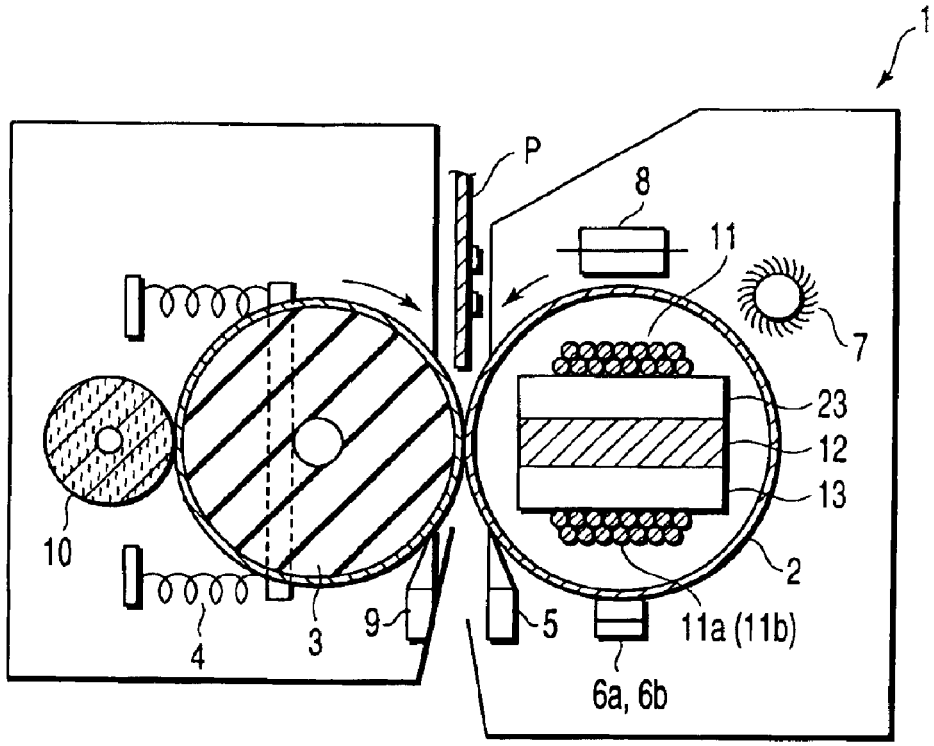
FIG. 1 is a diagram showing a longitudinal section of a fixing apparatus of an induction heating type according to an embodiment of the present invention.
Figure 2:
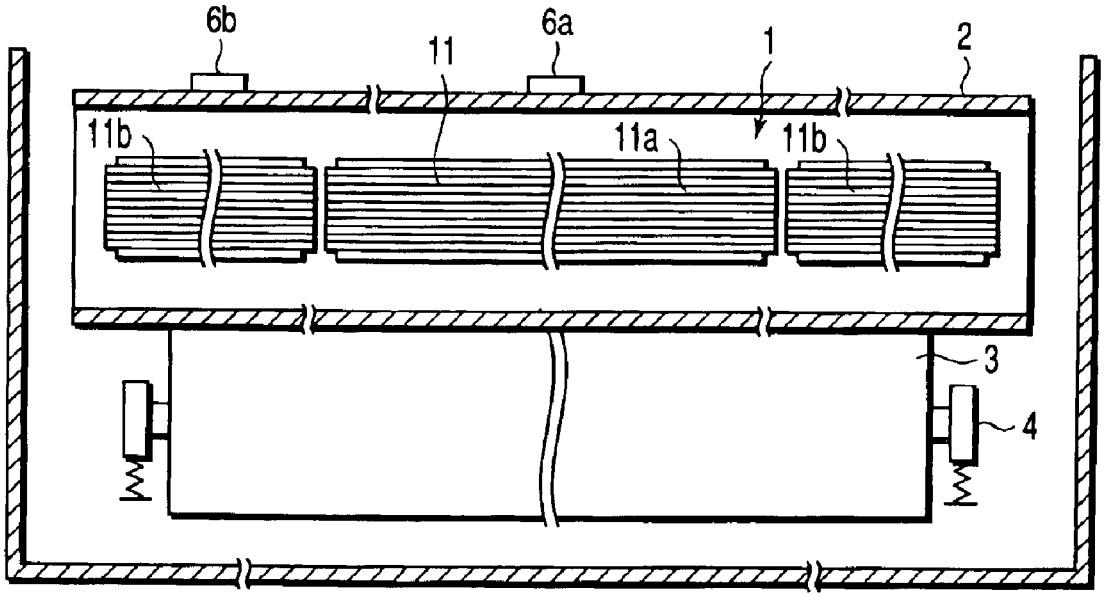
FIG. 2 is a diagram showing a cross section of the fixing apparatus.

FIG. 1 and FIG. 2 are diagrams showing a brief structure of the fixing apparatus according to an embodiment of the present invention, and this fixing apparatus is equipped in, for example, an image forming device.

FIG. 1 is a longitudinal section taken by imaginarily cutting the fixing apparatus 1 approximately from its center, and FIG. 2 is a diagram showing a cross section of the fixing apparatus 1 in such a state that the upper surface cover has been removed.

The fixing apparatus 1 includes a fixing (heat) roller 2 having a diameter of about 60 mm and a pressure (press) roller 3 having a diameter of about 60 mm. The fixing roller 2 is a metallic hollow cylinder having a thickness of about 1.5 mm. In this embodiment, iron is used as the material of the fixing roller 2; however the material may also be, for example, stainless steel, aluminum, or an alloy of stainless steel and aluminum.

The length of the fixing roller 2 in its axial direction is about 340 mm. The surface of the fixing roller 2 has a separation layer (not shown) formed thereon by depositing a fluorocarbon resin such as ethylene tetrafluoride (trade name: Teflon), which is a typical example thereof, to have a predetermined thickness.

The pressure roller 3 is a roller made of an elastic material such as silicon rubber or fluorocarbon rubber, formed (as a cover) to have a predetermined thickness, around a shaft. The length of the pressure roller 3 in its axial direction is about 320 mm.

The pressure roller 3 is arranged such that the axial line of itself is substantially in parallel with the axial line of the fixing roller 2, and the roller 2 is set in contact with the fixing roller 2 at a predetermined pressure by means of a pressure mechanism 4. In this manner, a portion of the outer circumference of the pressure roller 3 is elastically deformed, and a certain nip is formed between the rollers 2 and 3.

In a further downstream side than the nip in the direction of rotation of the fixing roller 2, there is provided a separation nail 5 that is designed to separate a paper sheet P that passes the nip from the fixing roller 2.

The fixing roller 2 is rotated at a constant rate in a direction indicated by the arrow by means of a driving force of a drum motor, which is not shown in the figure, designed to rotate the photosensitive drum, or a fixing motor, which is also not shown in the figure, designed to rotate the fixing roller 2.

The pressure roller 3, since it is in contact with the fixing roller 2 at a predetermined pressure by the pressure mechanism 4, is rotated at the constant rate to follow the rotation of the fixing roller 2.

Around the fixing roller 2, there are provided at least two temperature detection elements 6*a* and 6*b*, a cleaner 7 and a heating abnormality detection element 8 in this order along its rotating direction and in a direction away from the separation nail 5.

The temperature detection elements 6*a* and 6*b* are, for example, themistors designed to detect the temperature of the outer circumference of the fixing roller 2, and at least one of which is located at a substantially center of the fixing roller 2 in its longitudinal direction. The other thermistor is located at an end portion of the fixing roller 2 in its longitudinal direction. It should be noted that naturally three or more thermistors may be provided if necessary.

The cleaner 7 serves to remove toner attached to the fluorocarbon resin formed to have a certain thickness on the outer circumference of the fixing roller 2, paper dust created from paper sheets, dust suspended within the apparatus and eventually attached to the fixing roller 2, and the like.

The cleaner 7 includes a cleaning member made of a material that does not easily make scratches on the fluorocarbon resin that is in contact with the fixing roller 2, such as felt or fur brush, and a supporting member that supports the cleaning member.

It should be noted here that the cleaning member may be rotated as it is brought into contact with the surface of the fixing roller 2, or may be set contact at a predetermined pressure with the outer circumference of the fixing roller 2.

The heating abnormality detection element 8 is, for example, a thermostat, and it is designed to detect a heating abnormality, which is defined as an abnormal increase in the surface temperature of the fixing roller 2. When a heating abnormality is detected, the supply of electricity to a heat coil, which will be explained below, is stopped.

The arrangement of the temperature detection elements 6*a* and 6*b*, the cleaner 7 and the heating abnormality detection element 8 is not limited to the structure shown in FIG. 2.

On the other hand, on the circumference of the pressure roller 3, there are provided a separation nail 9 serving to separate a paper sheet P from the pressure roller 3 and a cleaning roller 10 serving to remove the toner attached to the circumferential surface of the pressure roller 3.

Inside the fixing roller 2, an excitation coil serving to generate an eddy current for the fixing roller 2 is provided. As shown in FIG. 2, the excitation coil 11 includes a first coil 11*a* located at substantially a central portion of the fixing roller 2 in its longitudinal direction and second coils 11*b* and 11*b* provided near the respective ends of the roller 2.

The second coil 11*b* is a coil made by winding a wire material having substantially the same resistivity and cross sectional area (number of strands) substantially the same number of turns as that of the first coil 11*a*. The second coils 11*b* are located at the ends of the roller 2 in its axial direction such as to interpose the first coil 11*a*in the longitudinal direction of the fixing roller 2.

The second coils 11*b* are two parts located on both sides of the first coil 11*a*, and they are connected in series to each other. With this structure, the second coils 11*b* are capable of generating an output substantially equal to that of the first coil 11*a*.

The first coil 11*a* is formed to have such a length that can heat a certain width of a sheet that is brought into contact with the outer circumference of the fixing roller 2 when, for example, a size-A4 paper sheet is conveyed such that its shorter side is set in parallel with the axial line of the fixing roller 2. Needless to say, the second coils 11*b* are useful to heat the vicinities of both ends of the fixing roller 2.

Each of the first and second coils 11*a* and 11*b* is formed of a Litz wire, which is prepared by stranding copper wires having a predetermined diameter, which are coated with a heat-proof material to insulate from each other, by an arbitrary number of times. In this embodiment, the diameter of each individual wire element of the Litz wire is 0.5 mm and the number of strands is 16. Further, as the coating material for insulating the wire elements from each other, polyimide is used.

Thus, with use of the Litz wire for each of the coils 11*a* and 11*b*, it is possible to reduce the diameter of each individual wire elements smaller than the depth of penetration of the skin effect that occurs when a high-frequency current flows through each wire element. Therefore, the substantial resistance to the high-frequency current can be reduced. In this manner, the power supplied to each of the claims 11*a* and 11*b* can be efficiently utilized.

Figure 3:
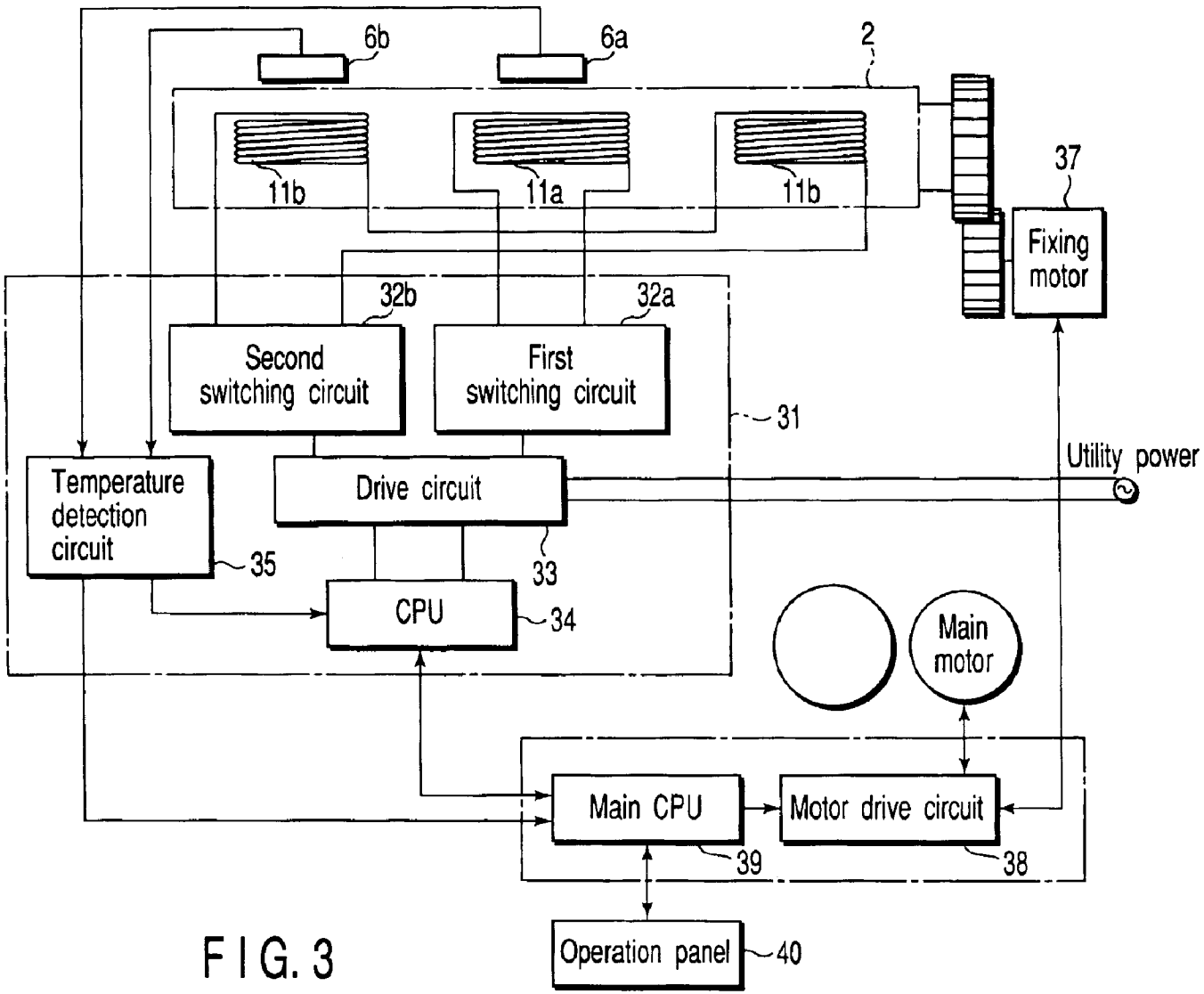
FIG. 3 is a diagram showing an excitation circuit that supplies a high-frequency current to the excitation coil of the fixing apparatus.

FIG. 3 shows an example of the excitation circuit that supplies a predetermined high-frequency current to the excitation coil 11 shown in FIGS. 1 and 2.

As can be seen in FIG. 3, a fist coil 11*b* located at the central portion is connected to a first switching circuit (inverter circuit) 32*a* of the excitation unit 31. Further, a second switching circuit (inverter circuit) 32*b* is connected to the second coils 11*b* provided at the respective ends.

The first and second switching circuits 32*a* and 32*b* switch a DC voltage supplied from a drive circuit 33 on the basis of the drive frequency instructed by the drive circuit 33, and thus they supply the voltage to each of the coils 11*a* and 11*b*.

The drive frequency instructed by each and individual inverter circuits 32*a* and 32*b* is made by the CPU 34, and it is in a range of, for example, 20 to 50 kHz.

Therefore, the first and second coils 11*a* and 11*b* are capable of generating a high frequency output of, for example, 760 W to 1.5 kW, when converted into electrical power, so as to heat the fixing roller 2 to a predetermined temperature.

In the case where the inverter circuits (the first and second switching circuits 32*a* and 32*b*) are used, the power supplied to the coils (11*a* and 11*b*) built in the circuits depends on the amplitude of the high frequency current that flows through the coils. The amplitude of the high frequency current can be set by changing the ON time of the switching element of the respective inverter circuit.

That is, the amplitude of the electric power supplied to an individual coil is changed on the basis of the timing for ON and OFF times of the switching element instructed from the CPU 34 to the drive circuit 33; however, from now on, it will be explained as the electric power outputted towards an individual coil.

The drive circuit 33 includes a rectifying circuit, and supplies an output voltage (DC voltage) of the rectifying circuit to the first and second inverter circuits 32*a* and 32*b*, alternately.

In other words, the drive circuit 33 functions also as a drive switch portion for supplying a predetermined electrical power to either one of the two coils 11*a* and 11*b*.

The amplitude of the power impressed to each of the coils 11*a* and 11*b* can be set arbitrarily by changing the ON time of the switching element of the inverter circuit, which is input from the drive circuit 33, as described above.

The drive frequency instructed by the drive circuit 33 for the first and second inverter circuits 32*a* and 32*b* is set by the CPU 34 on the basis of the temperature data output by the temperature detection circuit 35. The temperature data include the temperature at a central portion of the outer circumference of the fixing roller 2, which is detected by the first thermistor 6*a*, and the temperature at the ends of the fixing roller 2, which is detected by the second thermistor 6*a*.

A motor drive circuit 38 is connected to the fixing motor 37, and the motor drive circuit 38 us connected to a main CPU 39. The main CPU 39 is connected to an operation panel 40, as well as to the CPU 34 and the temperature detection circuit 35 mentioned above.

In this embodiment of the present invention, the excitation coil 11 described above is wound around a core member 12 formed to have a predetermined shape, with use of a coil bobbin 23 as shown in FIG. 1. The excitation coil 11, the core member 12 and the coil bobbin 23 form an induction heating device 13.

An insulation sheet member (not shown) is inserted between an inner circumferential surface of the heat roller 2 and the excitation coil 11 so as to keep them insulated from each other. The coil bobbin 23 is made of, for example, a resin material having an excellent insulating property and an excellent heatproof. Examples of the resin material are ceramics, phenol, liquid crystal polymer and unsaturated polyester. As the insulation sheet member, a material having a heat resistance temperature higher than the maximum temperature of the coil and a withstand voltage that can withstand the maximum voltage applied to the coil is used.

Further, as the insulation sheet member, a material having a contraction rate of no more than 25% under the above-described temperature condition and a thickness of 0.4 mm or more is used.

It should be noted that in this embodiment, PFA is used as the material for the insulation sheet member; however, as long as the above-described conditions are satisfied, PTFE or some other material can be used.

On the other hand, the core member 12 is made of an Mn—Zn-based, Ni—Zn-based or ceramic-based material, and its Curie temperature must be equal to or higher than the maximum temperature employed for the atmosphere in which the core member is placed. Otherwise, if the temperature of the core member 12 is increased by a continuous copying operation and becomes equal to or higher than the Curie temperature, the magnetic flux cannot pass through it, thereby resulting in output failure.

Figure 4:
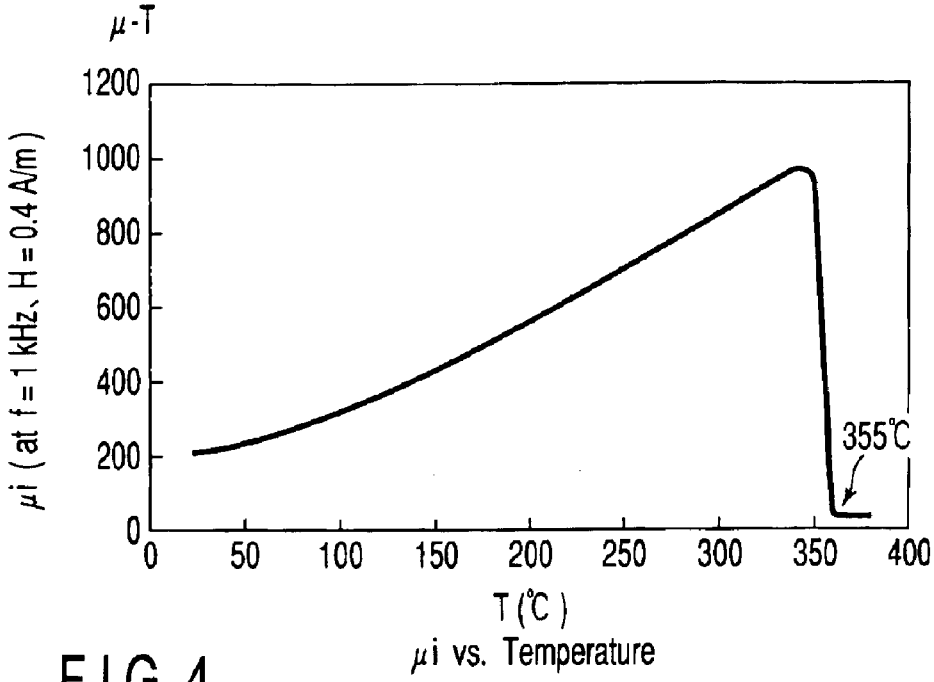
FIG. 4 is a graph indicating a Curie point of the core member of the fixing apparatus.
Figure 5:
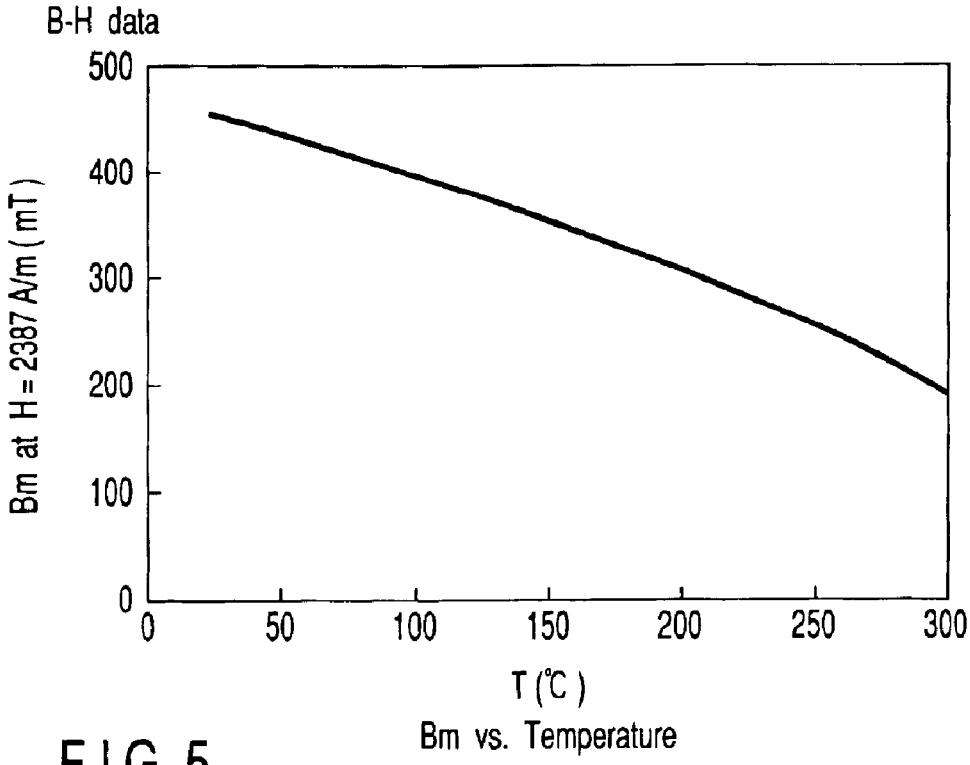
FIG. 5 is a graph indicating temperature characteristics of the core member of the fixing apparatus.

FIG. 4 and FIG. 5 are graphs illustrating the characteristics of the material (Ni—Zn-based) of the core member 12 in this embodiment.

In this embodiment, the temperature of the core member 12 increases to about 250° C. at maximum, and therefore a type having a Curie temperature of 350° C. or more is employed as can be seen from FIG. 4.

FIG. 5 shows the temperature characteristics of the material of the core member 12, and generally, the saturation magnetic flux density decreases as the temperature increases.

Here, it is important to select a core member that is appropriate for each respective fixing device. However, a high-performance material (, which does not lower the saturation magnetic flux density even if the temperature is increased) is naturally expensive, and therefore the selection must be made to satisfy both the prevention of decrease in the saturation magnetic flux density and the low cost.

In the present invention, the thickness of the core member 12 is optimized as a system, and thus it becomes possible to achieve an IH fixing apparatus that is relatively inexpensive and highly durable.

It should be pointed that where the inner diameter of the heat roller 2 is represented by D, the width of the portion of the core member 12, which opposes at least the heat roller 2 is represented by B, the inductance of the excitation coil 11 is L[μH] and the resistance of the heat roller 2 is R[Ω], B is set to be larger than L/R×0.3 and less than D/3, as will be described later.

The region of the L/R value that satisfies the output range of the excitation coil 11 under the above-described conditions is where 24≦L/R ≦32.

Figure 6:
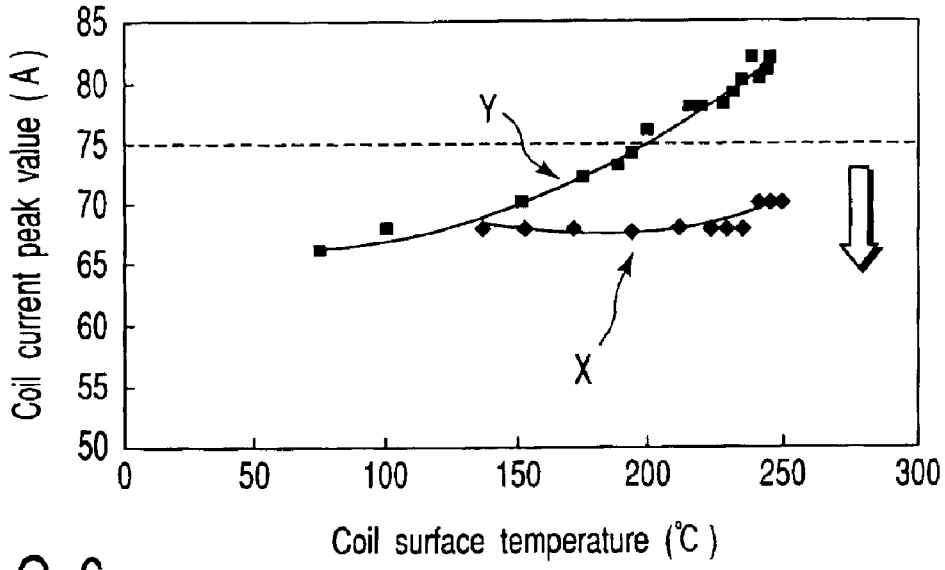
FIG. 6 is a graph indicating the relationship between the surface temperature of the coil and the coil current peak value in the cases where the thickness of the core member is 10 mm and it is 5 mm.

FIG. 6 shows the relationship between the surface temperature (° C.) of the excitation coil 11 of the heat roller 2 having the structure described above, and the coil current peak value (A).

In FIG. 6, line X indicates the case where the thickness B of the core member 12 is 10 mm. In this case, the coil current peak value does not increase even if the surface temperature of the excitation coil increases, and therefore the power element in the inverter circuit will not be damaged.

On the other hand, line Y indicates the case where the thickness B of the core member 12 is 5 mm. In this case, the coil current peak value increases as the surface temperature of the excitation coil increases, and therefore the power element in the inverter circuit may be damaged.

That is, according to the specification of the IGBT (Integrated Gate Transistor) element, which is the power element of the inverter circuit, the rated voltage and current are 600V and 80A. Therefore, it is necessary to suppress the current to 75A or less usually.

Figure 7:
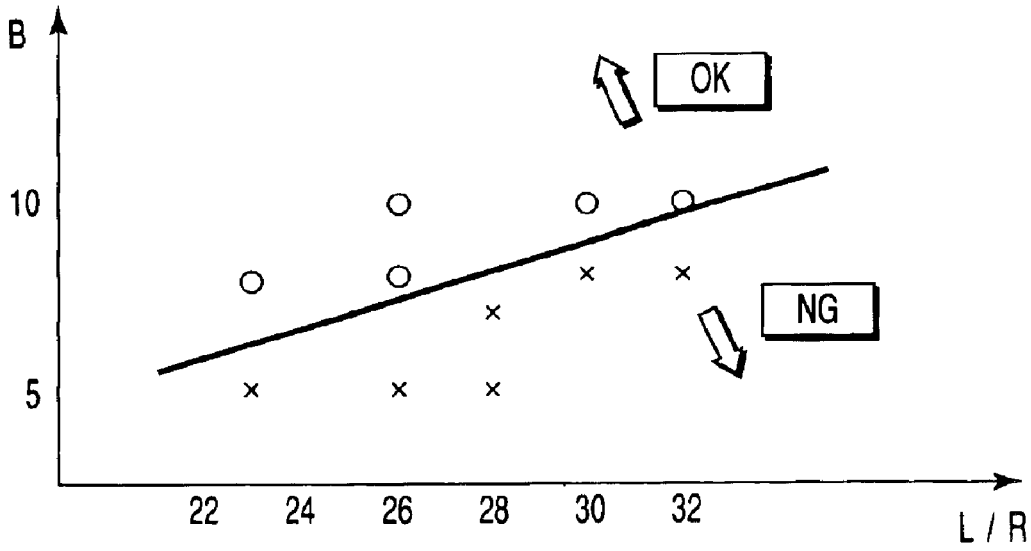
FIG. 7 is a graph indicating the cases where the current value flowing in the power element of an inverter circuit of the fixing apparatus is 75A or more, and it is 75A or less.

FIG. 7 shows the relationship between the L/R value (22 to 32) of the coil 11 and the thickness B of the core member 12, and indicates when the current flowing through the IGBT element is 75A or less, a case is regarded as OK "○", whereas when it exceeds 75A, a case is regarded as NO GOOD "x".

From this graph, it is understood that the border between "○" and "x" is a line expressed by a formula B=0.3×L/R. Therefore, when 0.3×L/R≦B, it is possible to prevent the damage of the power element by suppressing the current flowing in the IGBT to a value of 75A or less.

FIG. 8 is a graph showing the relationship between the L/R value and D/B value, and it indicates the variation of the value of L/R when D/B is changed.

When the current flowing to the IGBT element is 75A or less, a case is judged as "Δ", whereas when it exceeds 75A, a case is judged as "○".

That is, when the L/R value is in a range of 22 to 32, the D/B value must be 3 or higher to make the current flowing to the IGBT element 75A or less. Therefore, when B≦D/0.3, the power element in the inverter circuit will not be damaged.

For the reasons stated above, the thickness B of the core member 12 is set to be larger than L/R×0.3 and smaller than D/3.

FIG. 9 is a graph showing the relationship between the L/R value and the output [W] of the excitation coil 11, and it indicates the upper and lower limits of the output range when the L/R value is changed. As indicated by this figure, when the L/R value is in a range of 24 to 32, an output of 760 W to 1.5 kW can be obtained as specified. More preferably, when the L/R value is in a range of 25 to 31, the maximum output width can be obtained and therefore a more stable output can be obtained.

FIG. 10 is a table presenting measured values of L. R, L/R, B and D in the coil placed at the central portion and coils placed at the ends.

As can be understood from FIG. 10, the L/R value that satisfies the output range of the excitation coil is where 25≦L/R≦31.

As described above, where the inner diameter of the heat roller 2 is represented by D, the inductance of the excitation coil 11 is L[μH] and the resistance of the heat roller 2 is R[Ω], the width B of the portion of the core member 12, which opposes the heat roller 2 is represented by B is set to be larger than L/R×0.3 and less than D/3. With this definition, the occurrence of the magnetic saturation, which is caused by an increase in the temperature of the core member 12, can be suppressed, and the output range of the excitation coil 11 can be expanded.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A fixing apparatus comprising:

a fixing device including a fixing roller and a press roller set in contact with the fixing roller, configured to heat and press a to-be-fixed material by making the material pass between the fixing roller and press roller; and an induction heating device provided inside the fixing roller, configured to heat the fixing roller by induction heating, wherein the induction heating device includes a core member and an excitation coil wound around the core member, and the apparatus satisfies a relationship represented by L/R×0.3≦B×D/3, where D represents an inner diameter of the heat roller, L[μH] represents an inductance of the excitation coil, R[Ω] represents a resistance of the heat roller, and B represents a width of a portion of the core member, which opposes at least the heat roller.

2. The fixing apparatus according to claim 1, wherein the L/R satisfies a relationship represented by 24≦L/R≦32.

3. The fixing apparatus according to claim 1, wherein the excitation coil is made of a Litz wire of 16 strands, and a diameter of the Litz wire is 0.5 mm.

4. The fixing apparatus according to claim 1, wherein the core member is made of an Mn—Ni-based, Ni—Zn-based or ceramic-based material.

5. A fixing apparatus comprising:

a fixing device including a fixing roller and a press roller set in contact with the fixing roller, configured to heat and press a to-be-fixed material by making the material pass between the fixing roller and press roller; and an induction heating device provided inside the fixing roller, configured to heat the fixing roller by induction heating, wherein the induction heating device includes a core member and an excitation coil wound around the core member, the apparatus satisfies a relationship represented by L/R×0.3≦B≦D/3, where D represents an inner diameter of the heat roller, L[μH] represents an inductance of the excitation coil, R[Ω] represents a resistance of the heat roller, and B represents a width of a portion of the core member, which opposes at least the heat roller, and a drive circuit configured to supply a direct current voltage is connected to the excitation coil via a switching circuit.

* * * * *